United States Patent [19]

Stahlecker

[11] Patent Number: 4,538,328

[45] Date of Patent: Sep. 3, 1985

[54] DEVICE FOR INTERRUPTING FEED OF A ROVING TO A DRAWING FRAME

[75] Inventor: Gerd Stahlecker, Eislingen, Fed. Rep. of Germany

[73] Assignees: Fritz Stahlecker; Hans Stahlecker, both of Fed. Rep. of Germany

[21] Appl. No.: 610,504

[22] Filed: May 15, 1984

[30] Foreign Application Priority Data

May 25, 1983 [DE] Fed. Rep. of Germany ..... 3318925

[51] Int. Cl.[3] ..... D01H 13/16; D01H 13/18

[52] U.S. Cl. ..... 19/0.25; 19/258; 19/288; 57/87

[58] Field of Search ..... 19/0.2, 0.25, 258, 288; 28/185, 187, 188, 189, 225, 226, 234; 57/81, 87

[56] References Cited

U.S. PATENT DOCUMENTS

| | | | |
|---|---|---|---|
| 1,885,423 | 11/1932 | Fenton | 19/0.25 X |
| 2,763,035 | 9/1956 | Mackie | 28/189 X |
| 3,695,022 | 10/1972 | Landwehrkamp | 57/87 X |
| 4,280,321 | 7/1981 | Marzoli | 57/87 X |
| 4,326,371 | 4/1982 | Soar | 57/87 |
| 4,432,195 | 2/1984 | Stahlecker | 19/0.25 X |

FOREIGN PATENT DOCUMENTS

| | | |
|---|---|---|
| 2952533 | 7/1981 | Fed. Rep. of Germany . |
| 3048481 | 7/1982 | Fed. Rep. of Germany . |

*Primary Examiner*—Louis K. Rimrodt
*Attorney, Agent, or Firm*—Craig and Burns

[57] ABSTRACT

A device for interrupting feed of a roving on a drawing frame, having a feed roller pair, e.g., a powered bottom roller and a top roller tensioned against the bottom roller by springs, includes a clamp for lifting the top roller away from the bottom roller and clamping the roving against the circumference of the top roller. The clamp is disposed on a lever pivotable about an axis parallel to the axes of the feed roller pair and is shiftable with respect to a clamping edge, in the feed direction of the roving, toward the circumference of the top roller. The clamp includes a tongue which initially engages in the nip between the rollers and a portion having a toothed profile which cooperates with the clamping edge by engaging the roving.

10 Claims, 4 Drawing Figures

FIG. 1
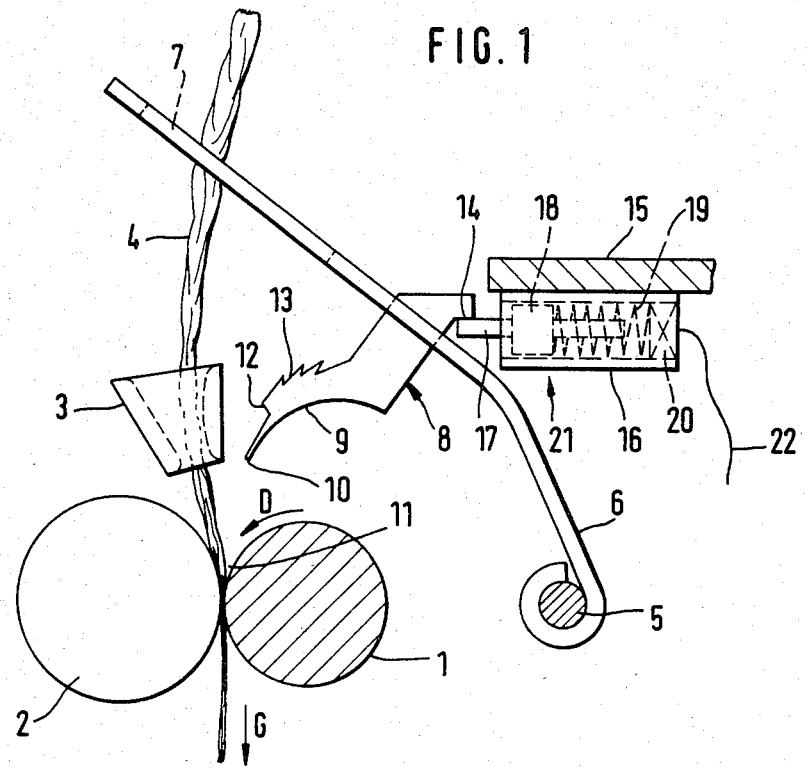
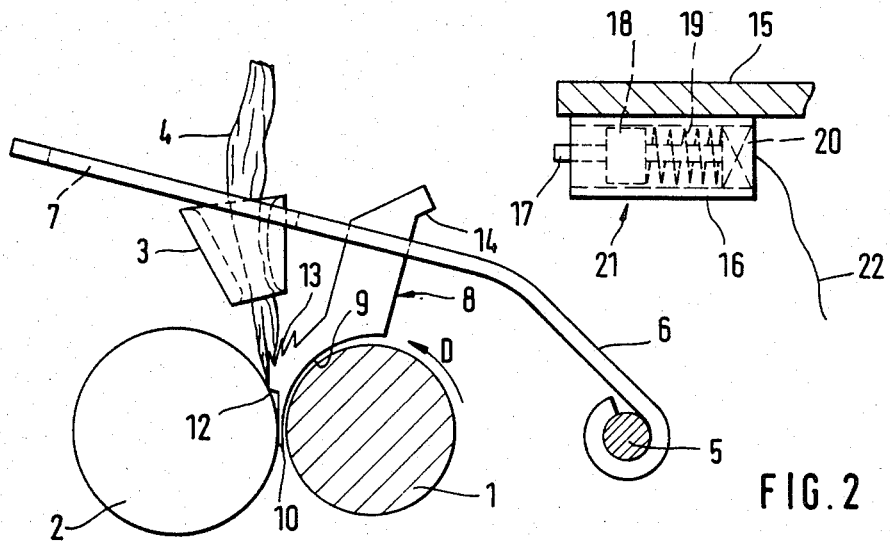
FIG. 2

DEVICE FOR INTERRUPTING FEED OF A ROVING TO A DRAWING FRAME

BACKGROUND OF THE INVENTION

The invention relates to a device for interrupting the feed of a roving to a drawing frame. A feed roller pair associated with the drawing frame includes a powered bottom roller and a top roller tensioned against the bottom roller by springs. A clamp is arranged in such a manner that it is introduceable from the feed side between the top roller and bottom roller for lifting the top roller away from the bottom roller and clamping the roving against the circumference of the top roller when a break is detected in the roving.

In a known device for interrupting the feed of a roving, German Offenlegungsschrift No. 30 48 481, an arcuate-shaped clamp is mounted on the bottom roller, the clamp being entrained in the circumferential direction by the bottom roller with the clamp being introduceable between the bottom and the top roller when a yarn break occurs. When the clamp is introduced between the top and bottom roller, the top roller is lifted away from the bottom roller and the roving is clamped against the circumference of the top roller. For structural reasons, clamping segments of this type are necessarily so light in construction that they are suitable only for relatively thin rovings. Accordingly, clamping segments of this type have been found to be not sufficiently operationally reliable for heavier rovings, for example, when used in yarn spinning machines.

In another known device for interrupting feed of a roving, German Offenlegungsschrift No. 29 52 533, a pivoted lever can be disposed in the vicinity of the feed roller pair of a drawing frame with the rotational axis of the lever running parallel to the feed rollers. This pivoted lever is designed as a lifting element, e.g., in the form of a wedge, and engages the top roller to thereby lift the top roller away from the bottom roller. A clamping pin for abutting the circumference of the top roller is provided on the pivoted lever and serves to clamp the roving. In this device, the top roller is supported at two points when roving feed is interrupted, namely at its axis and at its circumference, which may create difficulties if the two supporting elements are not properly aligned with one another. In particular, if the clamping pin is not pressed with sufficient force against the circumference of the top roller, there is a danger that the roving feed will not be effectively interrupted. Consequently, it is necessary in this device to provide the maximum possible actuating force.

SUMMARY AND OBJECTS OF THE INVENTION

The aim of the instant invention is, essentially, to provide a device that is suitable for interrupting feed of a roving, even for relatively heavy rovings, such that high actuating forces need not be applied to effectively interrupt the roving feed.

This aim is achieved by the instant invention wherein a clamp is mounted on a lever pivotable about an axis parallel to the axes of the feed roller pair and a clamping edge associated with the clamp which, when moved in the feed direction of the roving, engages at the circumference of the top roller and cooperates with the clamp to lift the top roller and ensure interruption of the feed of the roving. The top roller abuts the clamping edge with its circumference when in the raised position, thus ensuring reliable clamping even of a relatively heavy roving.

One advantageous feature of the invention is a wedge-shaped elastomeric tongue on the clamp. The tongue is introduceable between the top roller and bottom roller and is disposed on the clamp next to the clamping edge, which is provided on a thickened rigid area on the clamp. This design ensures that the clamp is drawn between the top roller and bottom roller by the wedge-shaped tongue until the clamping edge abuts the circumference of the top roller. Thus, the clamping force is applied by the feed roller pair itself, without any external force being required.

Another feature of the invention provides for the axis of the lever, which carries the clamp, being disposed generally in the plane containing the axes of the top roller and bottom roller, on the side of the bottom roller away from the top roller. This produces a spatially advantageous arrangement permitting a suitable movement of the lever and clamp relative to the rollers. If the surface of the clamp facing the bottom roller has a partially cylindrical shape, it is advantageous for the cylinder forming the basis for the surface to have a radius slightly greater than the radius of the bottom roller. This makes it possible to design the clamp to be so stiff that it raises the top roller without abutting the bottom roller.

In another feature of the invention, the area which adjoins the clamping edge of the clamp and faces the roving is provided with an irregular, i.e., toothed, profile. This profile engages the roving and further prevents a relatively heavy roving from being pulled through.

Another feature of the invention provides for the clamp being a molded plastic part. A molded plastic part of this type can advantageously generally be manufactured in the required shape at relatively little cost. An additional advantage is realized by utilizing plastic in that wear phenomena are reduced even in the vicinity of the tongue, where a sliding friction against the bottom roller occurs, due to the good sliding properties of the plastic.

In another feature of the invention, the lever together with the clamp is held in the operating position by means of a latch. The latch is releaseable by a yarn detector and the lever is so designed and/or disposed that after the latch is released the clamp automatically aligns itself with the feed roller pair. This ensures that the force required to release the latch is small. It is especially advantageous for the axis of the lever to be so disposed that the lever, together with the clamp, falls by gravity against the feed roller pair after the latch is released. This eliminates costly measures for creating the motion and clamping force, with the clamping force being produced primarily by the tongue being drawn into the nip between the top roller and bottom roller. The only function of gravity is to guide the clamp into the area between the top roller and bottom roller whereafter the tongue is engaged and drawn by the rollers.

Accordingly, it is an object of the present invention to provide a device for interrupting feed of a roving to a drawing frame which avoids, by simple means, shortcomings and disadvantages encountered in the prior art.

These and other objects, features, and advantages of the present invention will become more apparent from the following description when taken in connection with the accompanying drawings which show, for the purpose of illustration only, a single embodiment in accordance with the present invention.

BRIEF DESCRIPTION OF THE DRAWINGS

FIG. 1 shows a roving being fed between two rollers and a feed interrupting device according to the invention in a retracted or ready state;

FIG. 2 shows the feed interrupting device according to FIG. 1, following a yarn break, in a position interrupting the feed of the roving;

DESCRIPTION OF THE PREFERRED EMBODIMENT

Figure 3:
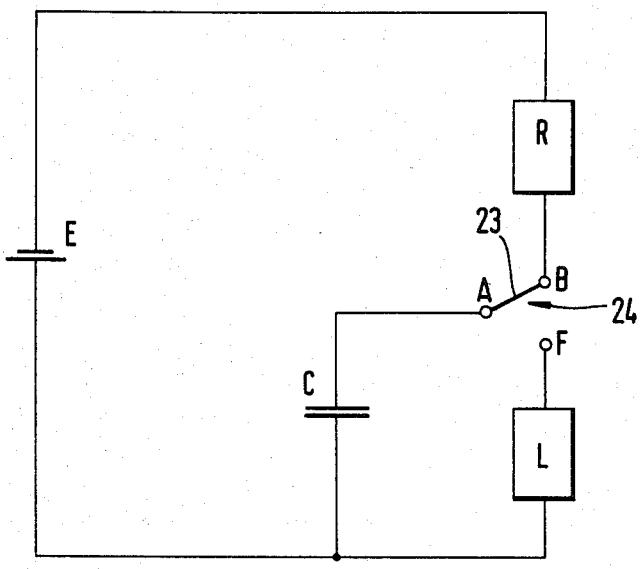
FIG. 3 is a schematic diagram of an electrical circuit for a locking device which retains the clamp in the retracted or ready position.

Referring now to the drawings wherein like reference numerals have been used throughout the various views to designate like parts and, more particularly, to FIGS. 1 and 2, according to these Figures, only feed roller pair 1, 2 of a drawing frame is shown. This feed roller pair 1, 2 includes a powered bottom roller 1 and a top roller 2, pressed by spring elements (not shown) against bottom roller 1. In a spinning machine (not shown), a plurality of such drawing frames, corresponding to the number of spinning units, is arranged side-by-side, whereby bottom roller 1 is generally designed as a cylinder or roller extending lengthwise of the machine and the roller is associated with a plurality of drawing frames mounted side-by-side. Top rollers 2 of each of these drawing frames can be designed as individual rollers or as "twin rollers." Each of the individually complete drawing frames contains at least two additional roller pairs (not shown), driven at higher rotational speeds, so that a roving 4 guided over a slubbing guide 3 is stretched in the direction of travel G. Top roller 2 and bottom roller 1 are arranged in a common generally horizontal plane with the other rollers being located vertically beneath whereby roving 4 travels in a generally vertical direction G.

An axis 5 for pivotable lever 6 is disposed next to feed roller pair 1, 2 and is generally in the same plane as the plane containing the axes of the roller pair 1, 2. Axis 5 is located on the side of bottom roller 1 away from top roller 2. Lever 6 carries a clamp 8 and includes an opening 7 through which roving 4 is fed. Lever 6 may be of many different forms including being shaped with two forked-shaped tines between which the roving passes. Clamp 8, made in the form of a molded plastic part, is mounted on lever 6 and includes a elastomeric wedge-shaped tongue 10. The clamp 8 is moveable relative to feed roller pair 1, 2 in such fashion that spring-elastic tongue 10 may engage and be drawn into the nip between top roller 2 and bottom roller 1. A clamping edge 12 adjoins the elastomeric tongue 10 in an area of the clamp 8 which has a greater cross section. The edge 12 engages on the circumference of top roller 2 when tongue 10 is drawn into the nip between top roller 2 and bottom roller 1. Rigid clamp 8 initially lifts top roller 2 away from bottom roller 1 a distance corresponding to the thickness of elastomeric tongue 10, with elastomeric tongue 10 subsequently being lifted away from bottom roller 1 after clamping edge 12 engages top roller 2. The area 9 of clamp 8 facing bottom roller 1, has a cylindrical shape with a radius slightly greater than the radius of bottom roller 1.

Clamp 8, at least in the area of clamping edge 12, which is preferably made in the form of a notch, has a width slightly greater than the width of roving 4 in the axial direction of top roller 2, so that roving 4 is clamped over its entire width against top roller 2 by the edge 12. An area provided with a toothed profile 13 adjoins clamping edge 12 and cooperates with the clamping edge 12 to interrupt the feed of the roving 4 by engaging the roving with the teeth formed therein.

Lever 6 and clamp 8 are held in the retracted or ready position, i.e., the operating position of the drawing frame (FIG. 1), by latch 21. When a thread break is detected latch 21 is released and lever 6 together with clamp 8 drops by its own weight so that tongue 10 enters the nip between top roller 2 and bottom roller 1 and is drawn therebetween (see FIG. 2). After the thread brake has been repaired, lever 6 and clamp 8 are moved back out of this interrupt position, for example by hand, and locked in the retracted or ready position (FIG. 1), i.e., the operating position of the drawing frame, by latch 21.

Clamp 8 extends beyond one side of lever 6 forming a locking stop 14, with which a locking pin 17 of locking device 21 is associated. Locking device 21 comprises a sleeve 16, fastened in a fixed position relative to a machine frame 15, in which locking pin 17, with a piston-shaped enlargement 18, is guided. Locking pin 17 is urged outward into the locking position by a spring 19 and is retracted from the locking position by a solenoid 20 connected to a power source by a lead 22.

Unlocking solenoid 20 is actuated in a manner releasing the clamp 8 and lever 6 by a yarn break detector (not shown). Actuation of the solenoid 20 occurs in a predetermined manner so that unlocking solenoid 20 is actuated only momentarily. Thus, locking pin 17 is retracted for only a short time and then released thereby permitting it to return to its extended, i.e., locking, position. Latch 21 is, accordingly, immediately ready to operate again and lever 6, with clamp 8, can immediately be locked again in the operating position of the drawing frame (FIG. 1) by pivoting the lever 6 about axis 5 and re-engaging locking stop 14 with pin 17.

Figure 4:
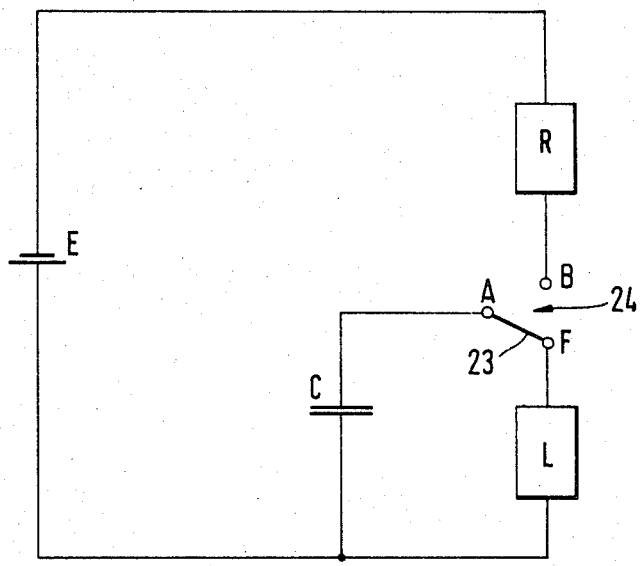
FIG. 4 shows the schematic diagram of the circuit in FIG. 3 after a yarn break has been detected.

In its preferred form, unlocking solenoid 20 is operated by a circuit of the type shown in FIGS. 3 and 4. The yarn detector includes a selector switch 24 connecting contacts A and B of a circuit containing a capacitor C with a power source E by a switching element 23 (FIG. 3). If the yarn breaks, switching element 23 of the yarn detector, in the form of a selector switch 24, pivots connecting contacts A and F with one another, whereupon a coil L of unlocking solenoid 20 is short-circuited to capacitor C and is briefly excited by the capacitor current. When yarn detector 24 returns to the operating position (FIG. 3) capacitor C is recharged and the device is prepared for another unlocking cycle.

While I have shown and described only one embodiment in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. A device for interrupting feed of a roving to a drawing frame having a feed roller pair associated therewith, the feed roller pair including a powered bottom roller and a top roller tensioned against the bottom roller, the device comprising clamp means introduceable from the feed side between the top roller and the bottom roller for interrupting feed of the roving, said clamp means including a clamping edge and a tongue means and being disposed on a lever means pivotable about an axis parallel to the axes of the feed roller pair, said clamping edge and said tongue means being shiftable with the clamp means in the feed direction of the roving for engaging and clamping the roving against the circumference of top roller and lifting the top roller away from the bottom roller, respectively.

2. The device according to claim 1, wherein the tongue means includes a wedge-shaped elastomeric tongue, said tongue being insertable between the top roller and bottom roller, said clamping edge being provided on a thickened, rigid area of the clamp means.

3. The device according to claim 1, wherein the axis of lever means is disposed generally in the plane containing the axes of top roller and bottom roller on the side of bottom roller away from top roller.

4. The device according to claim 1, including an area of the clamp means facing the bottom roller having a generally cylindrical shape, the radius of the generally cylindrical shaped surface being slightly greater than the radius of bottom roller.

5. The device according to claim 1, wherein the clamp means includes an area adjoining the clamping edge and facing the roving having a toothed profile.

6. The device according to claim 1, wherein the clamp means is a molded plastic part.

7. The device according to claim 1, further wherein the device includes latch means for holding the lever means and clamp means in a retracted or ready position, said latch means being releasable by a yarn break detector, whereby the lever means is so disposed that, subsequent to the latch means being released, the clamp means automatically aligns itself with feed roller pair.

8. The device according to claim 7, wherein the axis of the lever means and the lever means are disposed so that the clamp means engages the feed roller pair by gravity after the latch means is released.

9. The device according to claim 7, wherein said latch means includes locking means associated with said latch means for engaging the clamp means, said locking means being spring biased toward a locking position and being movable from the locking position in response to a signal from the yarn break detector.

10. The device according to claim 9, wherein said latch means includes electrical unlocking means for moving the locking means, said unlocking means being actuatable by pulses from the yarn break detector.

* * * * *